US011346628B2

(12) United States Patent
Russo

(10) Patent No.: US 11,346,628 B2
(45) Date of Patent: May 31, 2022

(54) THREADED TRIGGER PIN

(71) Applicant: Joel Russo, Harrisburg, PA (US)

(72) Inventor: Joel Russo, Harrisburg, PA (US)

( * ) Notice: Subject to any disclaimer, the term of this patent is extended or adjusted under 35 U.S.C. 154(b) by 0 days.

(21) Appl. No.: 17/152,488

(22) Filed: Jan. 19, 2021

(65) Prior Publication Data

US 2021/0222981 A1 Jul. 22, 2021

Related U.S. Application Data

(60) Provisional application No. 62/962,692, filed on Jan. 17, 2020.

(51) Int. Cl.
*F41A 19/15* (2006.01)

(52) U.S. Cl.
CPC ..... *F41A 19/15* (2013.01)

(58) Field of Classification Search
CPC ..... F41A 19/15
See application file for complete search history.

(56) References Cited

U.S. PATENT DOCUMENTS 4,837,963 A 6/1989 Slappey, Jr.
10,731,937 B2 * 8/2020 Schacht ..... F41A 19/10

* cited by examiner

*Primary Examiner* — J. Woodrow Eldred
(74) *Attorney, Agent, or Firm* — McKinnie & Paul, PLLC

(57) ABSTRACT

The present invention comprises a trigger pin having a threaded portion and a non-threaded portion and an action having a trigger assembly slot and at least one channel having a portion thereof threaded. In the preferred embodiment, the trigger pin is inserted through a first channel in the action, into a channel within the trigger assembly, and into a second channel in the action opposing the first channel in the action. The threaded portion of the pin is threadably engaged with the threaded portion of the first channel in the action.

14 Claims, 8 Drawing Sheets

THREADED TRIGGER PIN

CROSS-REFERENCES TO RELATED APPLICATIONS

This application claims the benefit of U.S. Provisional Application Ser. No. 62/962,692, filed Jan. 17, 2020 entitled Threaded Trigger Pin, which is incorporated by reference herein.

STATEMENT REGARDING FEDERALLY SPONSORED RESEARCH OR DEVELOPMENT

Not applicable.

BACKGROUND OF THE INVENTION

1. Field of the Invention

The present invention relates to secure a trigger assembly to an action as part of a rifle.

2. Background of the Related Art

Trigger pins are used to secure a trigger assembly to the bolt action of a rifle. The traditional trigger pin uses frictional engagement to hold the trigger assembly to the bolt action. Installing and removing the trigger pins require use of a hammer and punch.

SUMMARY OF THE INVENTION

The present invention utilizes a trigger pin having a smooth portion and a threaded portion. The threaded portion of the trigger pin engages with a threaded portion in an action to secure a trigger assembly to the action. The utilization of threads permits easier installation and removal of trigger pins and prevents potential for the punch to slip damaging the action.

DETAILED DESCRIPTION OF THE INVENTION

Figure 1:
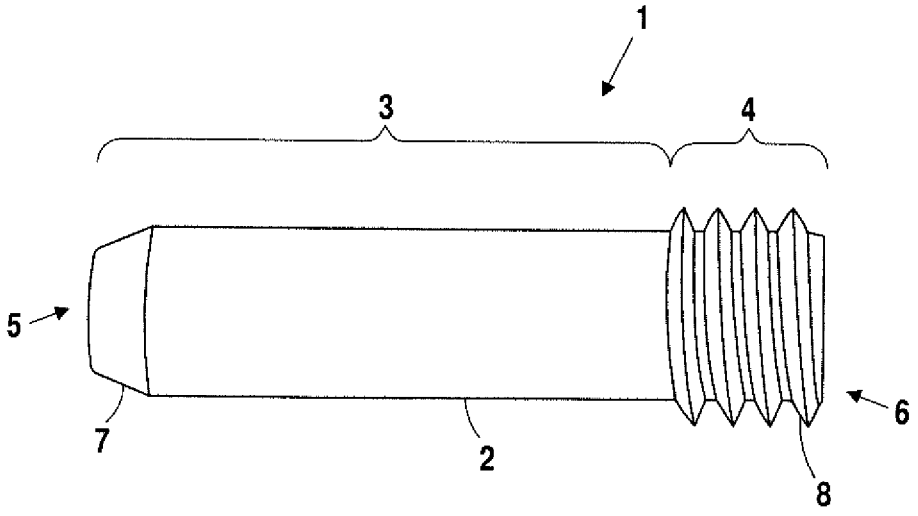
FIG. 1 is a side view of an embodiment of a trigger pin.
Figure 2:
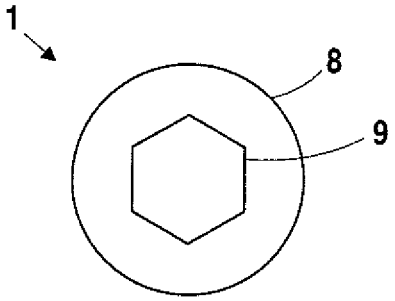
FIG. 2 is a top down view of an embodiment of a trigger pin.

As seen in FIGS. 1 and 2, the trigger pin 1 comprises a cylindrical shaft 2 having a smooth surface portion 3, a threaded portion 4, a first end 5, and a second end 6. The cylindrical shaft 2 first end 5 is chamfered 7 at the first end 5. The threaded portion 4 comprises threads 8 extending from the cylindrical shaft 2 which terminate at the second end 6. Preferably, the threads 8 extend approximately one fifth the length of the cylindrical shaft 2 as measured from the second end 6. The second end 6 further comprises a drive 9 shaped to receive a hex head wrench. The drive 9 may be modified to be compatible with a flat, Phillips, torx head screwdriver, or other shape. The trigger pin 1 may be metal, plastic or other suitably hard material. In the preferred embodiment the diameter of the smooth surface portion 3 cylindrical shaft 2 is approximately 0.125 inches. The length of the threaded portion may be variable as necessary.

Figure 3:
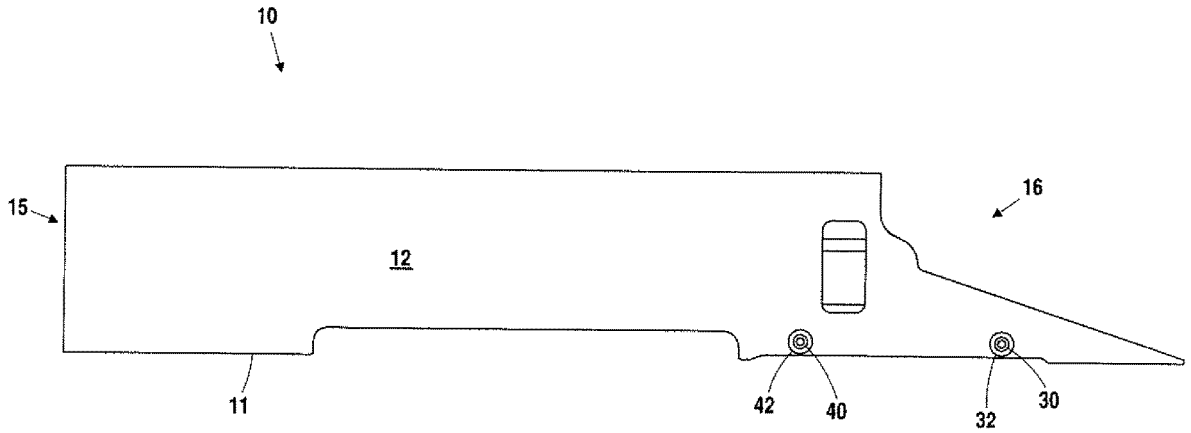
FIG. 3 is a side view of an action.
Figure 4:
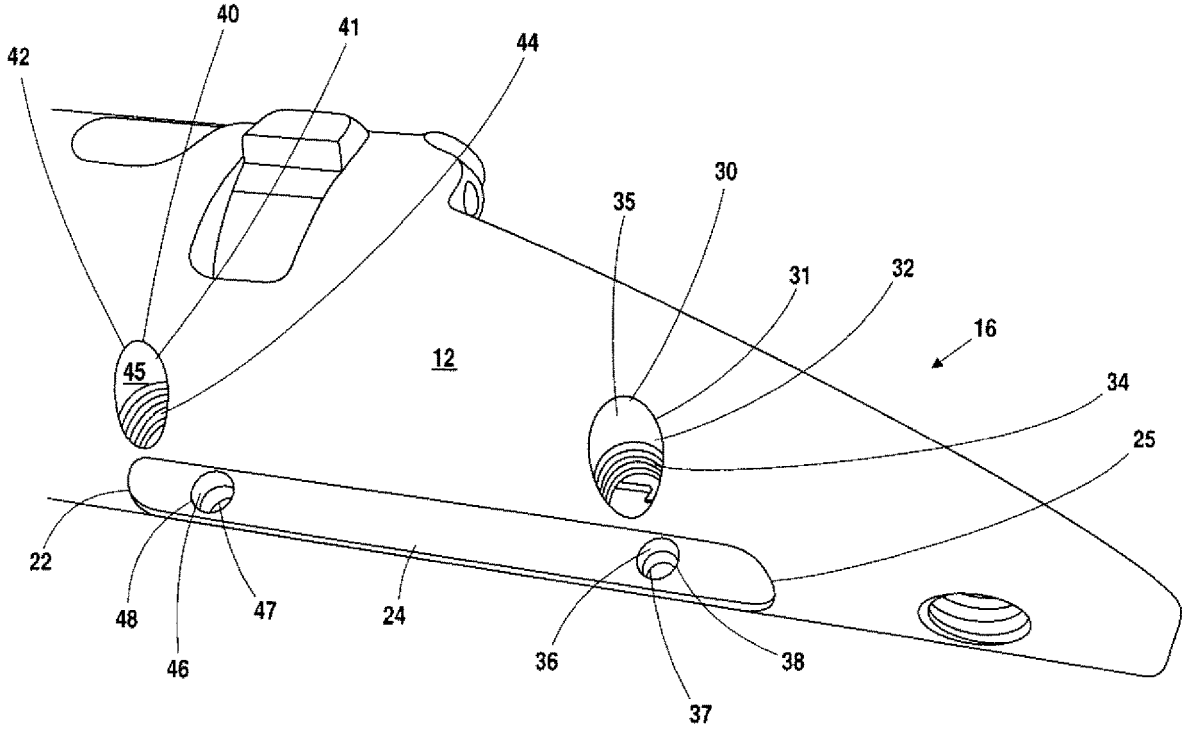
FIG. 4 is a close up view of the rear portion of an action.
Figure 5:
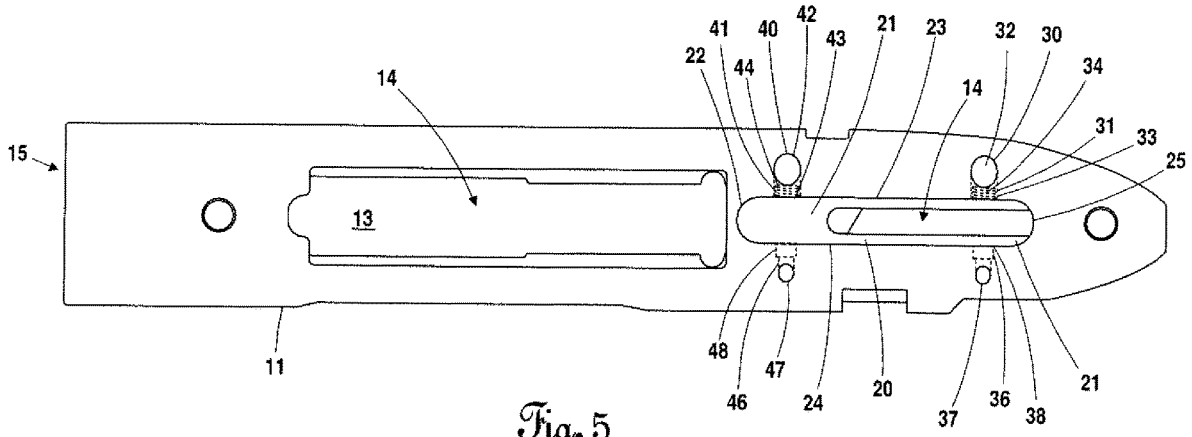
FIG. 5 is a bottom up view of an action.

As seen in FIGS. 3-5, the action 10 comprises a generally cylindrical sidewall 11 having an outer surface 12, inner surface 13, a cylindrical cavity 14, an open first end 15, and an open tapered second end 16. The action 10 has a trigger assembly slot 20 within the cylindrical sidewall 11 positioned near the open tapered second end 16. The trigger assembly slot 20 comprises a partial top wall 21, a front wall 22, a first side wall 23, a second side wall 24, and a back wall 25. A portion of the trigger assembly slot 20 opens into the cavity 14.

A first trigger pin receiver 30 comprises a first channel 31 and a second channel 36. The first channel 31 extends from a first opening 32 in the outer surface 12 of the cylindrical sidewall 11, through the cylindrical sidewall 11, where it terminates at a second opening 33 within the first side wall 23 of the trigger assembly slot 20. Threads 34 circumscribe a portion of the surface 35 of the first opening 32. Threads 34 correspond to the threads 7 of the trigger pin 1. The second channel 36 extends from a first opening 37 in the outer surface 12 of the cylindrical sidewall 11, through the cylindrical sidewall 11, where it terminates at a second opening 38 within the second side wall 24 of the trigger assembly slot 20. The center line of the first channel 31 and the second channel 36 are aligned. The second opening 33 and second opening 38 are near the back wall 25 of the trigger assembly slot 20. The diameter of the first channel 31 is sufficient to receive the largest diameter of the trigger pin 1. In the preferred embodiment, the diameter of the first channel 31 is larger than the diameter of the second channel 36. In the preferred embodiment, the diameter of the second channel 36 is sized to receive the diameter of the smooth surface 3 of the shaft 2 with a press fit.

A second trigger pin receiver 40 comprises a first channel 41 and a second channel 46. The second channel 41 extends from a first opening 42 in the outer surface 12 of the cylindrical sidewall 11, through the cylindrical sidewall 11, where it terminates at a second opening 43 within the first side wall 23 of the trigger assembly slot 20. Threads 44 circumscribe a portion of the surface 45 of the first opening 42. Threads 44 correspond to the threads 7 of the trigger pin 1. The second channel 46 extends from a first opening 47 in the outer surface 12 of the cylindrical sidewall 11, through the cylindrical sidewall 11, where it terminates at a second opening 48 within the second side wall 24 of the trigger assembly slot 20. The center line of the first channel 41 and the second channel 46 are aligned. The second opening 43 and second opening 48 are near the front wall 22 of the trigger assembly slot 20. The diameter of the first channel 41 is sufficient to receive the largest diameter of the trigger pin 1. In the preferred embodiment, the diameter of the first channel 41 is larger than the diameter of the second channel 46. In the preferred embodiment, the diameter of the second channel 46 is sized to receive the diameter of the smooth surface portion 3 of the shaft 2 with a press fit.

Figure 7:
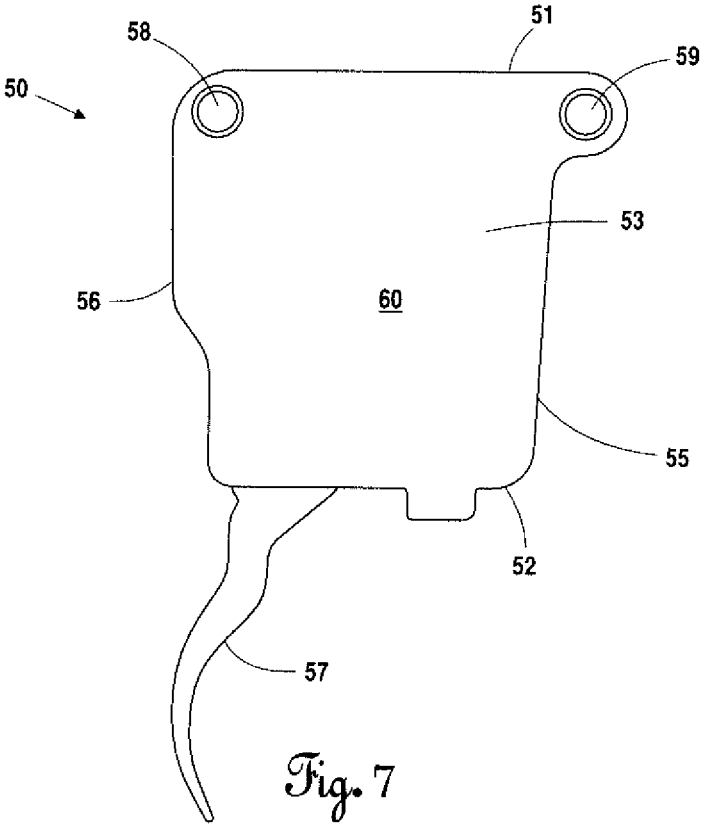
FIG. 7 is a side view of a trigger assembly.

A trigger assembly 50, as seen in FIG. 7, is generally boxed shaped having a top 51, bottom 52, a first side wall 53 opposing a second side wall 54, and a front side wall 55 opposing a rear side wall 56. A trigger 57 extends from the bottom 52. A first receiving channel 58 extends from a first surface 60 of the first side wall 53 to a second surface 61 of the second side wall 54. A second receiving channel 59 extends from a first surface 60 of the first side wall 53 to a second surface 61 of the second side wall 54. The first receiving channel 58 is positioned near the rear side wall 56 and the top 51. The second receiving channel 59 is positioned near the front side wall 55 and the top 51. The diameter of the first receiving channel 58 and second receiving channel 59 are approximately equal. In the preferred embodiment the diameter of the diameter of the first receiving channel 58 and second receiving channel 59 is approximately 0.125 inches.

Figure 6:
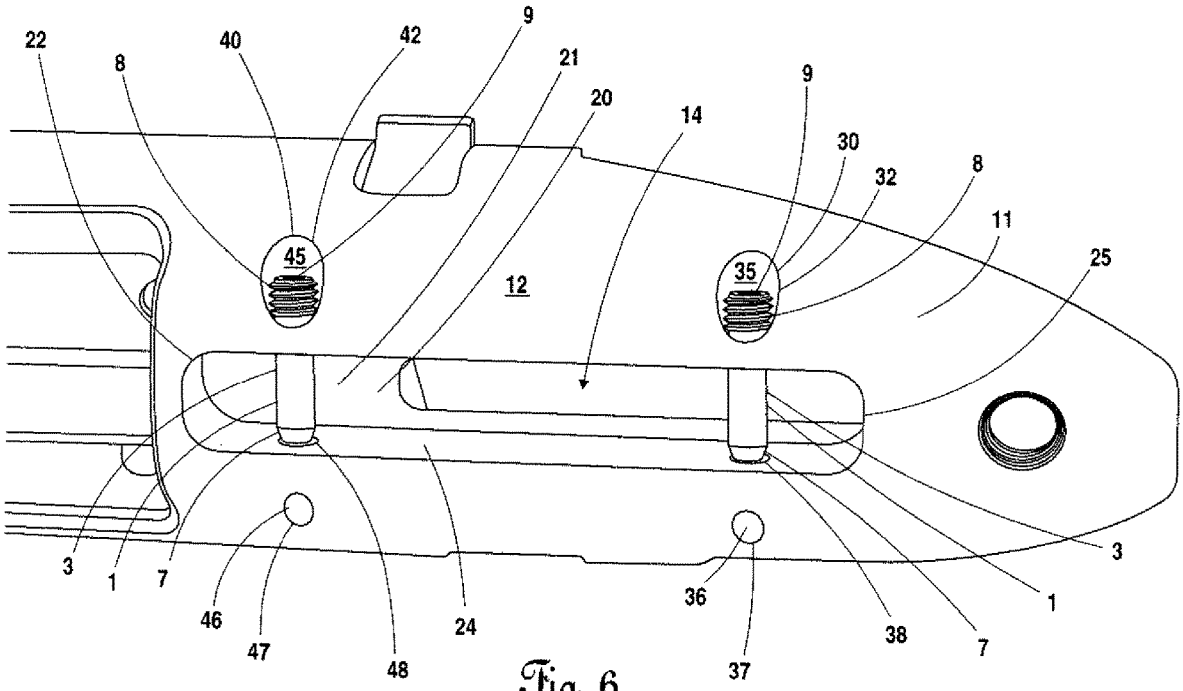
FIG. 6 is a perspective bottom up view of an action with trigger pins partially inserted.

As seen in FIG. 6, two trigger pins 1 are partially inserted into first trigger pin receiver 30 and second trigger pin receiver 40. Each trigger pin 1 inserts through the first opening 32, 42 of the first channel 31, 41 and out the second opening 33, 43. Each trigger pin 1 then inserts through the first opening 37, 47 of the second channel 36, 46. The chamfer 7 of the trigger pin 1 allows the trigger pin 1 to properly align itself for insertion into the second channel 36, 46.

Figure 8:
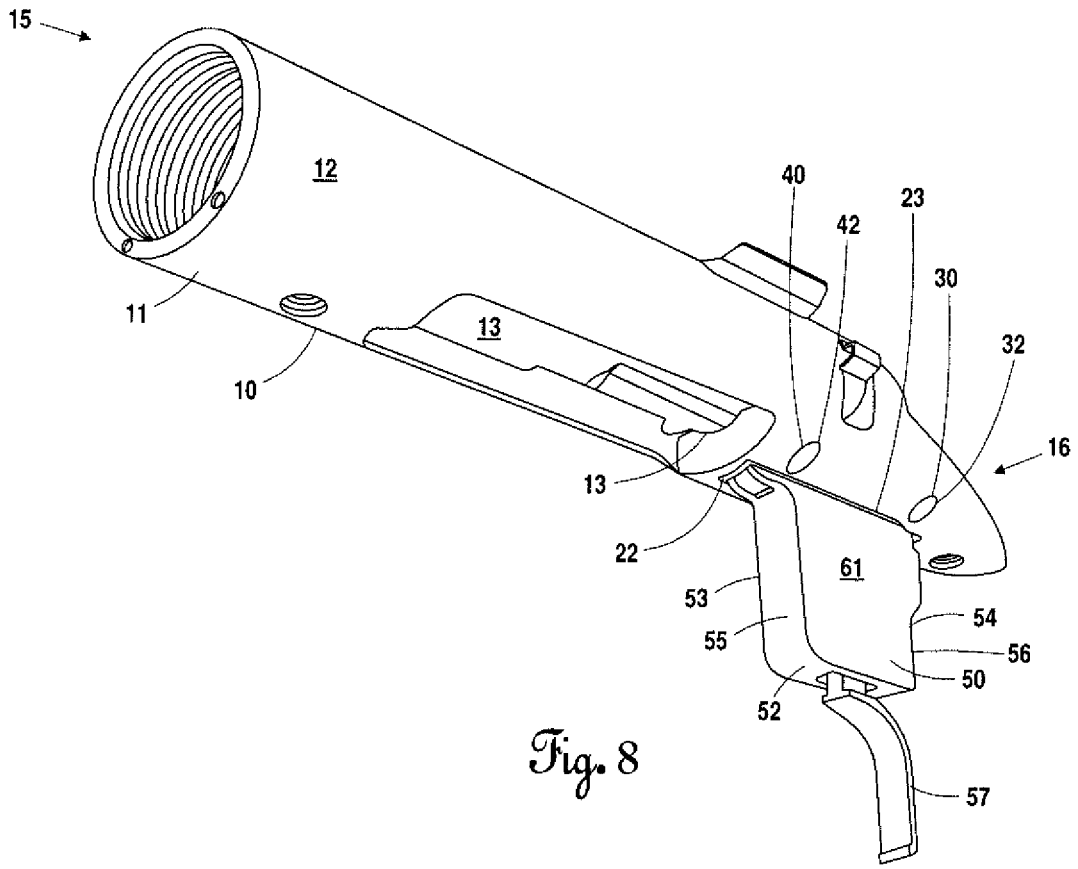
FIG. 8 is a perspective side view of an action with a trigger assembly.
Figure 9:
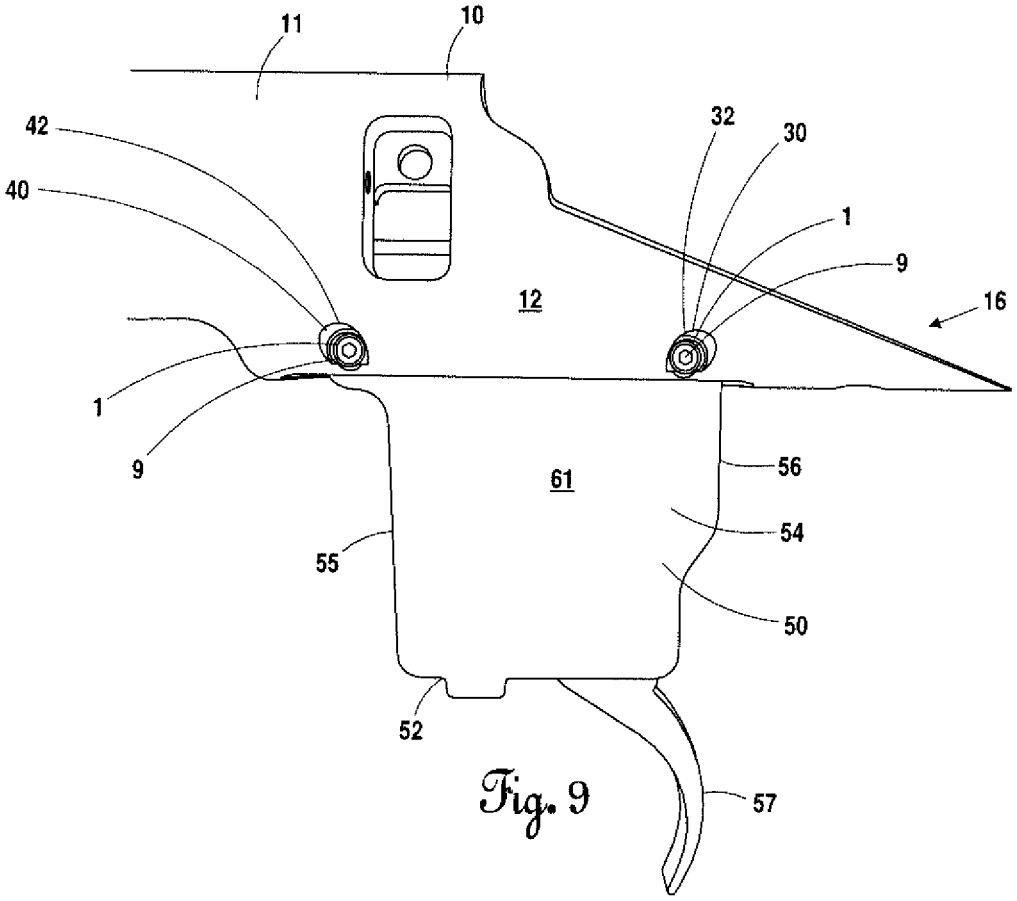
FIG. 9 is a perspective side view of the rear portion of an action with a trigger assembly secured by trigger pins.

As seen in FIGS. 8-9, the trigger assembly 50 is placed within the trigger assembly slot 20 such that the top 51 and front side wall 55 of the trigger assembly 50 abut the partial top wall 21 and front wall 22 of the trigger assembly slot 20 respectively. The first surface 60 of the first side wall 53 of the trigger assembly 50 abuts the second side wall 24 of the trigger assembly slot 20. The second surface 61 of the second side wall 54 of the trigger assembly 50 abuts the first side wall 23 of the trigger assembly slot 20. The first receiving channel 58 is generally aligned with the first trigger pin receiver 30 such that the first channel 31, first receiving channel 58, and second channel 36 form a combined channel. The second receiving channel 59 is generally aligned with the second trigger pin receiver 40 such that the first channel 41, second receiving channel 59, and second channel 46 form a combined channel.

A trigger pin 1 is inserted into the first opening 32 of the first trigger pin receiver 30 and pushed through the second opening 33, into the first receiving channel 58, into the second opening 38 of the second channel 36 until the threads 8 of the trigger pin 1 engage the threads 34 of the first trigger pin receiver 30. The chamfer 7 aids in aligning the first receiving channel 58 with the second opening 33 of the first channel 32 and the second opening 38 of the second channel 36. The hex head tool is then engaged with the drive 9 of the trigger pin 1 and turned clockwise to screw the trigger pin 1 into the first trigger pin receiver 30.

A trigger pin 1 is inserted into the first opening 42 of the second trigger pin receiver 40 and pushed through the second opening 43, into the second receiving channel 59, into the second opening 48 of the second channel 46 until the threads 8 of the trigger pin 1 engage the threads 44 of the first trigger pin receiver 40. The chamfer 7 aids in aligning the second receiving channel 59 with the second opening 43 of the first channel 42 and the second opening 48 of the second channel 46. The hex head tool is then engaged with the drive 9 of the trigger pin 1 and turned clockwise to screw the trigger pin 1 into the second trigger pin receiver 40.

The diameter of the smooth portion 3 of the trigger pin 1 and the diameter of the first receiving channel 58 and the second receiving channel 59 of the trigger assembly 50 create a slip fit. The diameter of the smooth portion 3 of the trigger pin 1 and the diameter of the second channel 36, 46 of the trigger assembly 50 creates a press fit. The press fit ensures each trigger pin 1 is tightly secured to the first channel 31, 41 and second channel 36, 46.

Each trigger pin 1 may be removed by inserting a hex head tool and turning the drive counterclockwise. Once the threads 8 are disengaged from the threads 34, 44 of the first trigger pin receiver 30 and second trigger pin receiver 40 respectively, the trigger pin 1 may be removed freeing the trigger assembly 50 from the trigger assembly slot 20.

The description of the present invention has been presented for purposes of illustration and description and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated. It will be understood by one of ordinary skill in the art that numerous variations will be possible to the disclosed embodiments without going outside the scope of the invention as disclosed in the claims.

I claim:

1. A rifle action assembly comprising
a pin having a drive, at least a portion thereof threaded;
a rifle action having a sidewall and a trigger assembly slot;
and a first channel disposed through the side wall into the trigger assembly slot wherein a portion of the first channel is threaded.

2. The rifle action assembly of claim 1 wherein the rifle action further comprises a second channel disposed through the side wall into the trigger assembly slot on an opposing side of the trigger assembly slot from the first channel wherein the second channel is aligned with the first channel.

3. The rifle action assembly of claim 2 wherein the pin further comprises a non-threaded portion extending from the threaded portion wherein the non-threaded portion terminates at a first end and the threaded portion terminates at a second end opposite the first end.

4. The rifle action assembly of claim 3 wherein the first end of the pin is chamfered.

5. The rifle action assembly of claim 3 wherein the diameter of the non-threaded portion of the pin is approximately equal to the diameter of at least a portion of the second channel.

6. The rifle action assembly of claim 3 wherein the trigger pin is secured within the second channel with a press fit.

7. A rifle action assembly comprising
a pin having a drive and at least a portion thereof threaded;
a trigger assembly having a first channel;
an action having a sidewall and a trigger assembly slot and a first channel disposed through the side wall into the trigger assembly slot;
wherein at least a portion of the first channel is threaded; and
wherein the first channel is aligned with the first channel of the trigger assembly.

8. The rifle action assembly of claim 7 wherein the action further comprises a second channel disposed through the side wall into the trigger assembly slot on an opposing side of the trigger assembly slot from the first channel wherein the second channel is aligned with the first channel.

9. The rifle action assembly of claim 8 wherein the pin further comprises a non-threaded portion extending from the threaded portion wherein the non-threaded portion terminates at a first end and the threaded portion terminates at a second end opposite the first end.

10. The rifle action assembly of claim 9 wherein the first end of the pin is chamfered.

11. The action assembly of claim 9 wherein the diameter of the non-threaded portion of the pin is approximately equal to the diameter of at least a portion of the second channel.

12. The action assembly of claim 9 wherein the pin is secured within the second channel with a press fit.

13. The action assembly of claim 9 wherein the diameter of the non-threaded portion of the pin is approximately equal to the diameter of at least a portion of the at least one channel of the trigger assembly.

14. The action assembly of claim 13 wherein the trigger pin is secured within the at least one channel of the trigger assembly with a slip fit.

* * * * *